US006010668A

United States Patent [19]

Lawrence et al.

[11] Patent Number: 6,010,668

[45] Date of Patent: Jan. 4, 2000

[54] END CONE ASSEMBLY AND METHOD FOR CATALYTIC CONVERTER

[75] Inventors: Robert Anthony Lawrence, Flushing; Roger Eugene Buck, Fenton, both of Mich.

[73] Assignee: General Motors Corporation, Detroit, Mich.

[21] Appl. No.: 09/024,444

[22] Filed: Feb. 17, 1998

[51] Int. Cl.[7] ..... F01N 3/10; B01D 53/34

[52] U.S. Cl. ..... 422/176; 422/177; 422/179

[58] Field of Search ..... 422/174, 176, 422/177, 180, 179; 60/300, 299, 302

[56] References Cited

U.S. PATENT DOCUMENTS 3,801,289 4/1974 Wiley ..... 422/179

5,408,828 4/1995 Kreucher et al. ..... 422/176

*Primary Examiner*—Hien Tran

*Attorney, Agent, or Firm*—Vincent A. Cichosz

[57] ABSTRACT

An end cone assembly for a catalytic converter includes a larger formed sheet metal outer cone and a smaller formed sheet metal inner cone forming a dual wall cone assembly. The cones have large ends and connecting conical walls which are configured like those of a prior art end cone and are formable by the same tooling. The cones have inner ends connected with the conical walls that are modified to connect with smaller diameter exhaust pipes and require modified tooling to make. The prior art cones have cylindrical small ends that are telescoped together and locked by dimples. The small end of the new inner cone varies from the conical configuration of its respective wall in, first, curving outward toward an axial direction, second, curving inward toward a radial direction and, third, curving outward to an essentially axial direction defining a generally cylindrical outer end. The small end of the new outer cone varies from the conical configuration of its respective wall in, first, curving outward toward an axial direction and, second, curving inward to an essentially radial direction and terminating in an opening closely surrounding the cylindrical outer end of said inner cone to essentially close an insulating space at the outer end thereof. Time and expense are saved by the new design end cones by requiring die or tooling changes in only two of seven manufacturing steps in converting between making cones for various sized exhaust pipes. Thus, a first set of common dies may be used for forming work pieces from which all sizes of outer cones are made and a second set of common dies may be used for forming work pieces from which all sizes of inner cones are made.

6 Claims, 3 Drawing Sheets

FIG 3
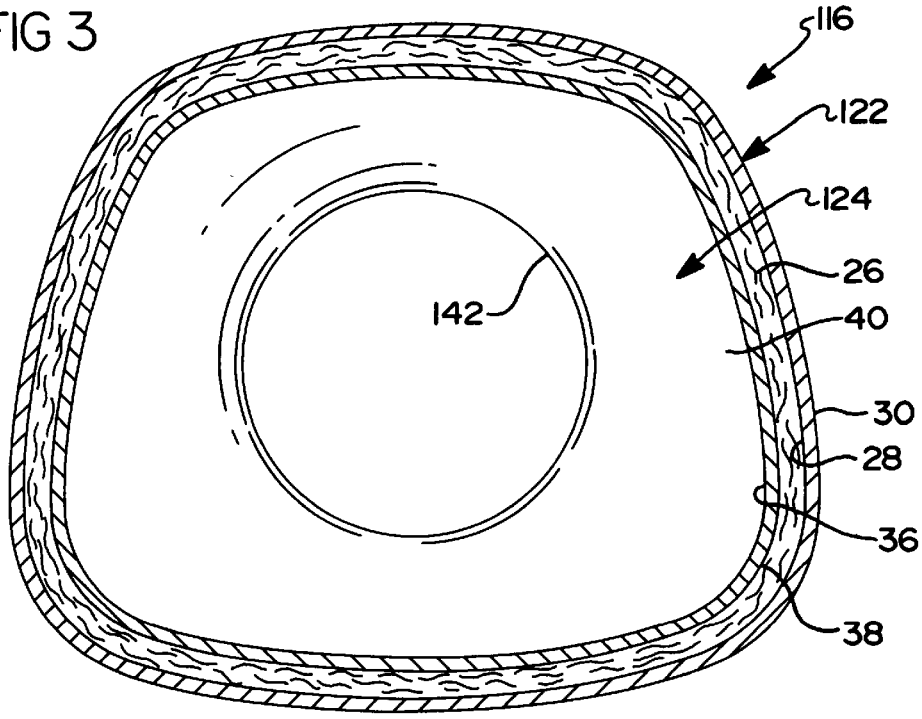
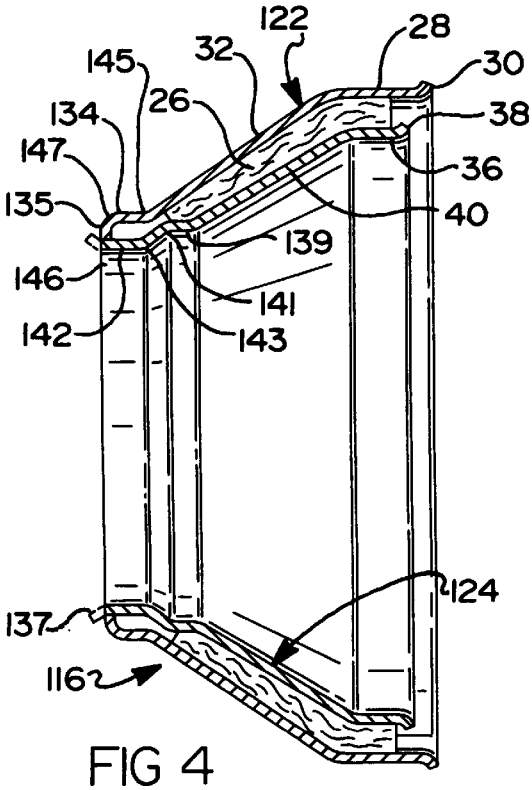
FIG 4
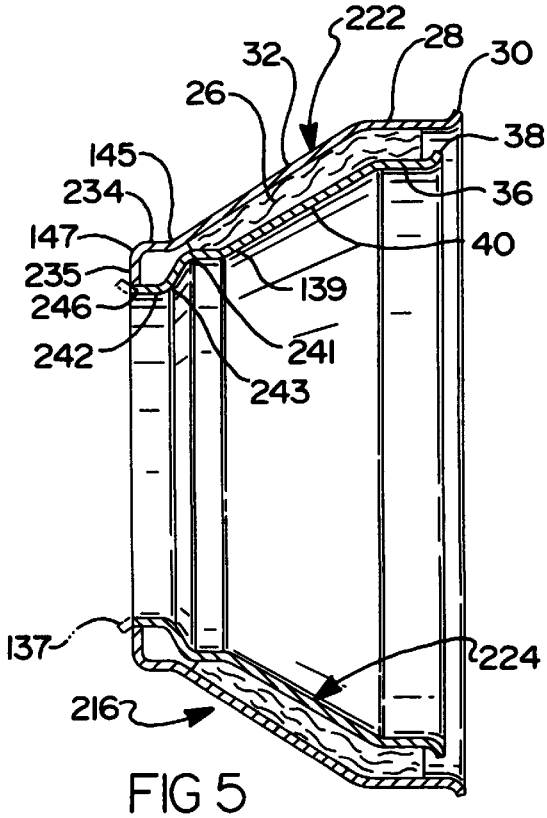
FIG 5

END CONE ASSEMBLY AND METHOD FOR CATALYTIC CONVERTER

TECHNICAL FIELD

This invention relates to end cone assemblies for use as end members in catalytic converter housings and to their configuration and methods of manufacture to form exhaust pipe connecting openings of various sizes.

BACKGROUND OF THE INVENTION

It is known in the art relating to vehicle engine exhaust catalytic converters for controlling exhaust emissions to provide a housing including an insulated cylindrical shell to which end cone assemblies are welded for connecting the converter to associated exhaust pipes or components. A catalytic element is assembled into the cylindrical shell prior to installing and welding the end cone assemblies on to the shell. The shell may have a circular cross section or be of any suitable non-circular configuration.

FIG. 1 shows in cross section part of a prior catalytic converter including a housing 10 having a non-circular cylindrical shell 12 enclosing an insulating pad 13 wrapped around a catalytic element 14 of any suitable type. The shell 12 is connected at both ends (only one end being shown) with an end cone assembly 16 of known construction, best shown in FIG. 2. An adapter 18 is inserted in and welded to an outer end 20 of the end cone assembly.

The end cone assembly 16 includes a formed sheet metal outer cone 22 and a smaller formed sheet metal inner cone 24 with a fibrous insulating pad 26 between them to form the insulated dual wall cone assembly 16.

The outer cone 22 includes an outer large end 28 that is generally cylindrical and sized to slide over one end of the converter shell 12. A slight outward flare 30 is provided at the free edge of the outer large end 28 to assist the installation. The outer large end 28 connects with a generally conical outer wall 32 leading to an outer small end 34 which again is generally cylindrical but of preferably circular cross section.

The inner cone 24 also includes an inner large end 36 that is generally cylindrical and sized to fit within the same end of the converter shell 12. A slight outward flare 38 at the free edge of the inner large end 36 engages the insulating pad 13 within the shell 12. The inner large end 36 connects with a generally conical inner wall 40 leading to an inner small end 42 which again is generally cylindrical but of preferably circular cross section. The inner small end 42 is sized to fit closely within the outer small end 34 of the outer cone 22 so that these ends 34, 42 engage one another. To maintain the parts in assembly, dimples 44 may be formed in the engaged small ends 34, 42. In the illustrated embodiment, the inside diameter of the small end 42 is about 2.5 in. (63.5 mm) in order to connect with exhaust pipes of about 2.5 in. outer diameter.

The conical outer and inner walls 32, 40 of the assembly 16 are spaced apart to define an insulating space in which is disposed the preferably fibrous insulating pad 26. Other forms of high temperature insulation may also be used. The pad 26 is preferably installed on the inner cone 24 before inserting it into the outer cone 22 to form the end cone assembly 16.

Finished end cone assemblies 16 are installed on both ends of the converter shell 12 after assembly of the wrapped catalytic element 14 into the shell 12. The end flares 30 of the outer cones are then welded to the outside of the shell 12 to hold the end cone assemblies 16 in place and seal the joints against gas leakage.

In the prior embodiment of FIG. 1, the end cone assembly 16 is shown connected with the adapter 18 which is inserted into the inner small end 42 of the assembly and welded around the joint to make it gas tight. If desired, other forms of exhaust pipe connections could be attached to the end cone assembly.

The outer and inner cones 22, 24 of the assembly 16 are each formed by a seven step sheet metal forming process including steps of blanking, drawing (three steps), restrike, piercing and extruding. Thus one set of seven transfer dies are required for the production of each cone. Previously, when a larger or smaller pipe connection opening was required to connect with larger or smaller exhaust pipes, the illustrated assembly was designed with completely new outer and inner cones. This required provision of two new sets of dies, seven dies per set for each cone, and complete change out of all the dies whenever a production change between smaller and larger opening cone assemblies was required, all involving considerable time and expense. The same situation exists for end cones produced by progressive dies.

SUMMARY OF THE INVENTION

The present invention provides new designs of end cone assemblies and simplified methods of their manufacture for catalytic converters of the type previously described. The new assemblies involve end cones in which the outer ends and conical walls of the new cones remain the same as those of the large opening version of the described prior cones. Only the small ends of the cones are varied from the prior cone designs. The changes in the cone small ends are such that only the last two steps of the manufacturing process, the piercing and extruding steps of the process, are changed. As a result, end cones for connection with smaller sized exhaust pipes can be made from the tooling used for the larger opening end cones with a change of a maximum of only two new die sets for each of the inner and outer cones or the addition of interchangeable tooling details within the two original die sets. In one case, the piercing step for the outer end cone remains the same so that only one new die set or a set of interchangeable tooling details is required. This improvement radically reduces the cost and time required for producing various sizes of end cones.

Reshaping of the inner ends of the end cones results in new end cone assemblies in which the inner and outer cones each have a large end for connecting with a cylindrical housing of a catalytic converter and a small end for connecting with a pipe and having generally conical walls intermediate their respective ends, the walls being in spaced relation between their ends to form an insulating space between them and the cones engaging one another at their small ends.

The small end of the inner cone varies from the conical configuration of its respective wall in, first, curving outward toward an axial direction, second, curving inward toward a radial direction and, third, curving outward to an essentially axial direction defining a generally cylindrical outer end.

The small end of the outer cone varies from the conical configuration of its respective wall in, first, curving outward toward an axial direction and, second, curving inward to an essentially radial direction and terminating in an opening closely surrounding the cylindrical outer end of said inner cone to essentially close the insulating space at an outer end thereof.

These and other features and advantages of the invention will be more fully understood from the following description of certain specific embodiments of the invention taken together with the accompanying drawings.

BRIEF DESCRIPTION OF THE DRAWINGS

In the drawings:

FIG. 3 is an inner end view of one embodiment of improved end cone assembly according to the invention;

FIG. 4 is a transverse cross-sectional view of the assembly shown in FIG. 3;

FIG. 5 is a cross-sectional view similar to FIG. 4 but showing an alternative embodiment of improved end cone assembly according to the invention;

DESCRIPTION OF THE PREFERRED EMBODIMENTS

Figure 2:
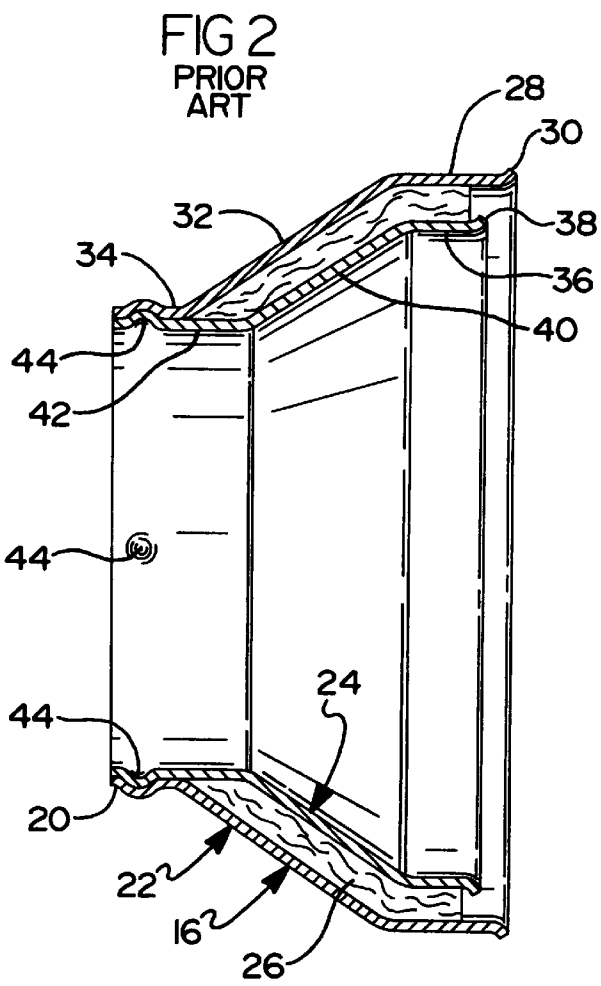
FIG 2 PRIOR ART
FIG. 2 is a transverse cross-sectional view showing the construction of the prior art end cone assembly of the converter of FIG. 1.
Figure 1:
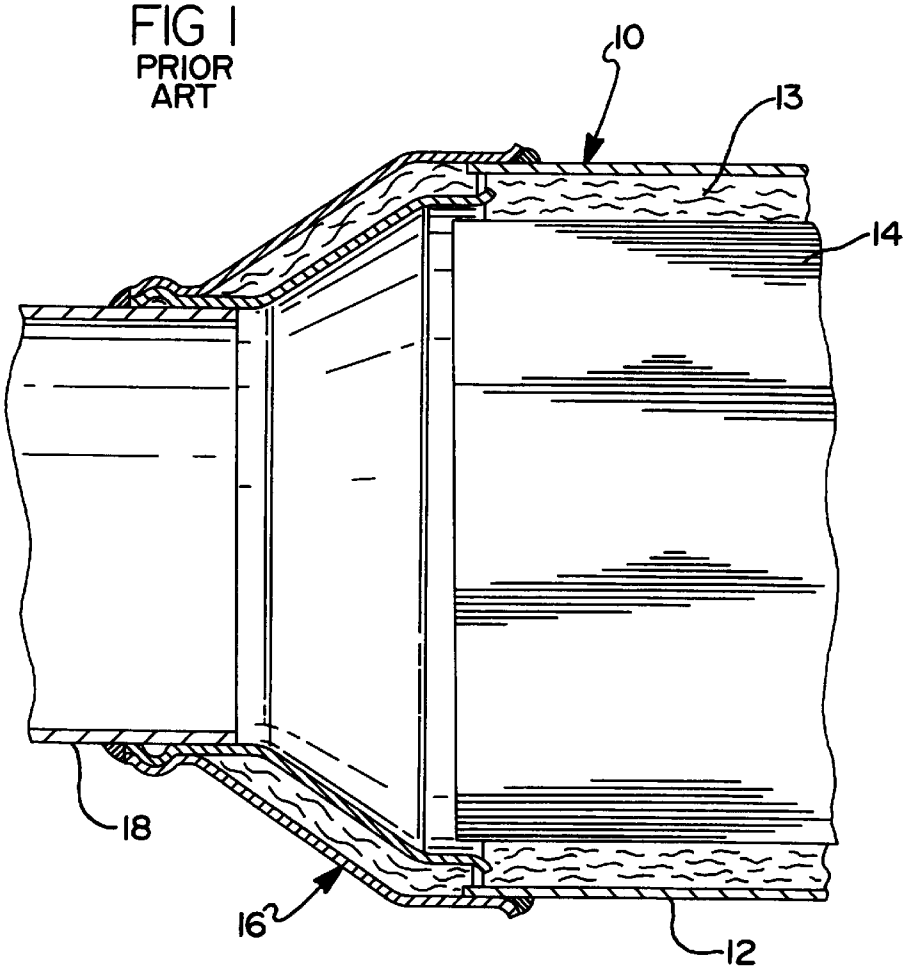
FIG 1 PRIOR ART
FIG. 1 is a fragmentary transverse cross-sectional view showing the internal construction of an exemplary prior art catalytic converter.

Referring now to FIGS. 3 and 4 of the drawings, like reference numerals denote like parts or features while 100 series numerals denote modified parts or features. Numeral 116 generally indicates an improved end cone assembly for use with catalytic converters of the type described where connection of the converter housing with smaller sized exhaust pipes or pipe connectors is desired. The end cone assembly 116 includes a formed sheet metal outer cone 122 and a smaller formed sheet metal inner cone 124 with a fibrous insulating pad 26 between them to form the insulated dual wall cone assembly 116.

The outer cone 122 includes an outer large end 28 that is generally cylindrical and sized to slide over one end of the converter shell 12. A slight outward flare 30 is provided at the free edge of the outer large end 28 to assist the installation. The outer large end 28 connects with a generally conical outer wall 32 leading to an outer small end 134 which is partially tubular but has an inwardly radial lip 135 at the end.

The inner cone 124 also includes an inner large end 36 that is generally cylindrical and sized to slide into the same end of the converter shell 12. A slight outward flare 38 provided at the free edge of the inner large end 36 engages the insulating pad 13 within the shell 12. The inner large end 36 connects with a generally conical inner wall 40 leading to an inner small end 142 which is tubular and of varying diameter but of preferably circular cross section. The inner small end 142 is sized to fit closely within the lip 135 of the outer small end 134 of the outer cone 122 so that these ends 134, 142 engage one another. If it is desired to maintain the parts in assembly prior to installation on a converter shell, the inner small end 142 may be extended slightly beyond the lip 135 and bent outward as shown in phantom at 137, thus holding the inner cone 124 within the outer cone 122.

It should be noted that the large ends 28, 36 and the conical walls 32, 40 of the outer and inner cones 122, 124 are identical to those of cones 22 and 24 of the prior art assembly 16. However, the small ends 134, 142 differ from those of the prior cones 22 and 24 to provide a smaller opening in the inner small end 142 of about 2¼ in. inner diameter for receiving a similarly sized exhaust pipe.

The conical outer and inner walls 32, 40 of the assembly 116 are spaced apart to define an insulating space in which is disposed the preferably fibrous insulating pad 26. Other forms of high temperature insulation may also be used. The pad 26 is preferably installed on the inner cone 124 before inserting it into the outer cone 122 to form the end cone assembly 116.

The small end 142 of the inner cone 124 varies from the conical configuration of its respective wall 40 in, first, curving outward at 139 toward an axial direction, second, curving inward at 141 toward a radial direction and, third, curving outward at 143 to an essentially axial direction defining a generally cylindrical outer end 146 with the approximately 2¼ in. inner diameter.

The small end 134 of the outer cone 122 varies from the conical configuration of its respective wall 32 in, first, curving outward at 145 toward an axial direction and, second, curving inward at 147 to an essentially radial direction and terminating in the lip 135 having an opening closely surrounding the cylindrical outer end 146 of said inner cone 124 to essentially close the insulating space at an outer end thereof.

Finished end cone assemblies 116 are installed on both ends of the converter shell 12 after assembly of the pad wrapped catalytic element 14 into the shell 12. The end flares 30 of the outer cones are then welded to the outside of the shell 12 to hold the end cone assemblies 116 in place and seal the joints against gas leakage.

FIG. 5 illustrates an alternative embodiment of end cone assembly 216 according to the invention. Assembly 216 is sized for connection with a 2 in. exhaust pipe but is otherwise very similar to the end cone assembly 116 just described. Like reference numerals identify like parts and features while 200 series numerals denote modified parts or features. Differences are confined to the outer and inner cones 222, 224, respectively, which both have their small ends 234, 242 modified to connect with the smaller pipe. To accomplish this, inner small end 242 of the inner cone 224 curves further inward at 241 and further outward at 243 to provide the smaller diameter cylindrical outer end 246 required. Also, the radial lip 235 of the outer small end 234 is extended to contact the smaller diameter outer end 246 of the inner small end.

Manufacture of the inner and outer cones for assemblies according to the invention is illustrated in FIGS. 6–10. The first five steps of blanking, drawing in three stages and restriking are the same for end cones according to the invention and for those of the prior art.

Figure 6:
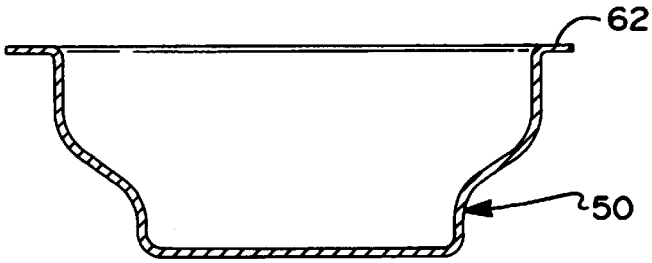
FIG. 6 is a cross-sectional view of a formed blank resulting from the restrike step in manufacture of an outer cone according to the invention.
Figure 7:
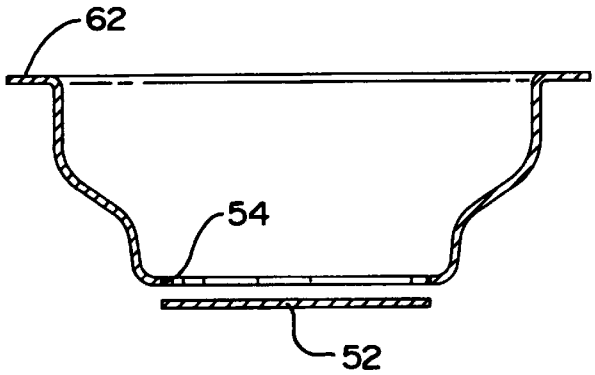
FIG. 7 is a view similar to FIG. 6 but illustrating the product of a subsequent piercing step for the outer cone.

For the outer cone, the formed workpiece 50 after restrike is shown in FIG. 6. FIG. 7 shows the result of piercing the flat end of the workpiece 50 to remove a slug 52 and form an opening 54 of predetermined size. The extrusion step which follows to form the cylindrical small end of the outer cone for the prior art is omitted in the improved embodiments of FIGS. 3–5.

Figure 8:
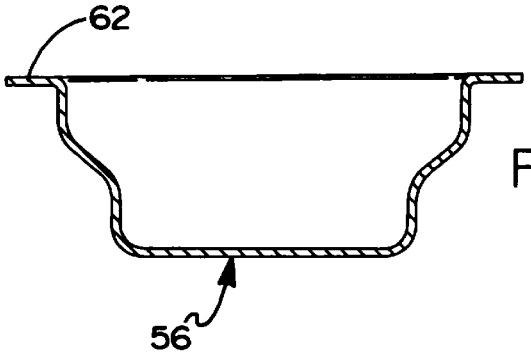
FIG. 8 is a view similar to FIG. 6 but illustrating the formed blank from the restrike step for an inner cone according to the invention.
Figure 9:
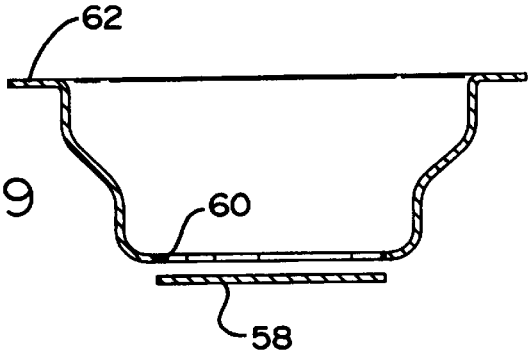
FIG. 9 is a view similar to FIG. 7 but illustrating the product of a subsequent piercing step for the inner cone.
Figure 10:
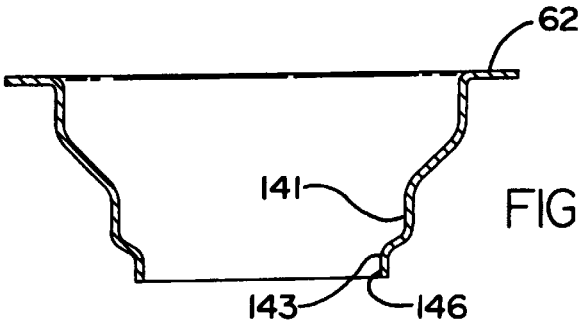
FIG. 10 is a view similar to FIG. 9 but illustrating the product of the modified extrusion step forming the finished inner cone.

For the inner cone, a similar but smaller sized formed workpiece 56 after restrike is shown in FIG. 8. FIG. 9 shows the result of piercing to remove a slug 58 and form an opening 60 of predetermined size. The extrusion step which follows to form the cylindrical small end of the inner cone is modified as shown in FIG. 10 to produce the inward curve 141 or 241 and the return outward curve 143 or 243 to form the reduced diameter cylindrical outer end 146 or 246 of an inner cone as in FIG. 4 or 5. In every case the flanges 62 shown at the open ends of the work pieces 50,56 are subsequently trimmed off leaving the end flares 30, 38 on the outer and inner cones.

For the embodiment of FIG. 4, connectable with a 2¼ in. pipe, the piercing step of FIG. 7 produces the proper size opening for the outer cone 122 using the dies provided for the prior art embodiment of FIG. 2. For the embodiment of FIG. 3, connectable with a 2 in. pipe, new piercing dies or interchangeable tooling details within the original dies, for making a smaller opening are needed.

The above examples reference interchangeable pierce and extrude tooling that can be used with the original die set. Such tooling may be desirable where volume capacities are not a concern and there is adequate time in the production schedule for tooling changeovers. New dies are required only to minimize changeover time, e.g., on high volume productions. In the event that this invention is used with end cones previously built on progressive dies, then the use of interchangeable tooling may be preferred. In the claims below, the word "tooling" refers to both interchangeable tooling and dies.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. An end cone assembly for a catalytic converter, said cone assembly including a formed sheet metal outer cone and a formed sheet metal inner cone forming a dual wall cone assembly said outer cone being larger than said inner cone, said inner and outer cones each having a large end for connecting with a cylindrical housing of a catalytic converter and a small end for connecting with a pipe and having generally conical walls intermediate their respective ends, said walls being in spaced relation between their ends to form an insulating space between them, said cones engaging one another at their small ends, characterized in that:

said small end of the inner cone varying from the conical configuration of its respective wall in, first, curving outward toward an axial direction, second, curving inward toward a radial direction and, third, curving outward to an essentially axial direction defining a generally cylindrical outer end, and said small end of the outer cone varying from the conical configuration of its respective wall in, first, curving outward toward an axial direction and, second, curving inward to an essentially radial direction and terminating in an opening closely surrounding the cylindrical outer end of said inner cone to essentially close said insulating space at an outer end thereof.

2. An end cone assembly as in claim 1 and further including insulating material in said insulating space between said generally conical walls.

3. An end cone assembly as in claim 2 wherein said insulating material is a fibrous mat.

4. An end cone assembly as in claim 1 wherein said small end of the inner cone terminates essentially in axial alignment with said small end of the outer cone.

5. An end cone assembly as in claim 1 wherein said small end of the inner cone extends beyond said small end of the outer cone and is deformed to maintain the inner and outer cones in assembly prior to connection of the end cone with the converter housing.

6. An end cone assembly as in claim 1 wherein the cross sectional configuration of the large ends of the end cones is non circular while the cross sectional configuration of the small ends is circular.

* * * * *